US007151467B2

(12) United States Patent
Fujita et al.

(10) Patent No.: US 7,151,467 B2
(45) Date of Patent: Dec. 19, 2006

(54) VEHICULAR COMMUNICATIONS APPARATUS AND METHOD

(75) Inventors: Susumu Fujita, Yokohama (JP); Toru Takagi, Yokohama (JP); Masao Yamane, Yokosuka (JP); Toshiro Muramatsu, Zushi (JP); Okihiko Nakayama, Yokohama (JP)

(73) Assignee: Nissan Motor Co., Ltd., Kanagawa-Ken (JP)

( * ) Notice: Subject to any disclaimer, the term of this patent is extended or adjusted under 35 U.S.C. 154(b) by 195 days.

(21) Appl. No.: 11/030,290

(22) Filed: Jan. 7, 2005

(65) Prior Publication Data

US 2005/0156756 A1 Jul. 21, 2005

(30) Foreign Application Priority Data

Jan. 9, 2004 (JP) ..... P2004-004261

(51) Int. Cl.
*G08G 1/00* (2006.01)
*G08G 1/123* (2006.01)

(52) U.S. Cl. ..... 340/902; 340/903; 340/988; 340/995.1

(58) Field of Classification Search ..... 340/902, 340/903, 904, 905, 933, 935, 936, 988, 995.1, 340/995.13, 995.17
See application file for complete search history.

(56) References Cited

U.S. PATENT DOCUMENTS 6,249,232 B1 * 6/2001 Tamura et al. ..... 340/902
6,445,308 B1 * 9/2002 Koike ..... 340/902
6,615,137 B1 * 9/2003 Lutter et al. ..... 701/301
6,720,920 B1 * 4/2004 Breed et al. ..... 342/386
6,765,495 B1 * 7/2004 Dunning et al. ..... 340/903
6,801,138 B1 * 10/2004 Koike ..... 340/902
7,046,168 B1 * 5/2006 Tsuboi ..... 340/903

FOREIGN PATENT DOCUMENTS

JP 2003-099888 A 4/2003

* cited by examiner

*Primary Examiner*—Toan N. Pham
(74) *Attorney, Agent, or Firm*—McDermott Will & Emery LLP

(57) ABSTRACT

A vehicular communications apparatus is configured to calculate information on relative positions, relative velocities, and relative moving directions between own vehicle and other vehicles at a point such as a junction where other vehicles tend to affect running of the own vehicle, and to search for and decide other vehicles which are to be opponents of radio communications, based on a calculated result, and communication opponents are decided from among the searched other vehicles, and radio communications are conducted therewith, and then, the vehicular communications apparatus obtains information on the other vehicles, in a time-sequential manner and by radio communications, and present the information to a driver of the own vehicle from time to time, thereby causing the driver to recognize dynamic information on the other vehicles, enabling the own vehicle to smoothly join a flow of traffic at a junction, for example.

12 Claims, 9 Drawing Sheets

FIG. 7

| | | SECRECY DEGREE | RUNNING IMPORTANCE LEVEL |
|---|---|---|---|
| FLAGS | 0 | • POSITIONAL INFORMATION<br>• VELOCITY INFORMATION<br>• MOVING DIRECTION INFORMATION | • VOICE INFORMATION THROUGH VoIP<br>• DVD IMAGE |
| | 1 | • INDIVIDUAL AUTHENTICATION INFORMATION<br>• VOICE INFORMATION THROUGH VoIP | • POSITIONAL INFORMATION<br>• VELOCITY INFORMATION<br>• MOVING DIRECTION INFORMATION<br>• CAMERA IMAGE |

VEHICULAR COMMUNICATIONS APPARATUS AND METHOD

BACKGROUND OF THE INVENTION

1. Field of the Invention

The present invention relates to a vehicular communications apparatus and a vehicular communications method.

2. Description of Relevant Art

There has been disclosed in Japanese Patent Application Laid-Open Publication No. 2003-99888 an apparatus adapted, when own vehicle is unable to obtain adequate traffic information directly from an associated infrastructure, to obtain necessary traffic information from other vehicles.

SUMMARY OF THE INVENTION

This apparatus has no protocol for deciding which vehicle should be connected for communications, and is subjected to a potential failure in connection with, for example, such a vehicle that may affect own vehicle joining another lane at a junction of traffic lanes.

For a smooth joining, it is essential for the own vehicle to enter radio communications, such as with a suddenly interrupting vehicle, to obtain (action-representative) dynamic information of the vehicle.

However, absent appropriate protocol, the above-noted apparatus main fail in connection for communications with such an interrupting vehicle, failing to obtain essential information.

Therefore, even with the provision of an indicator for indication of information to a driver, this driver is still unable to recognize essential information such as dynamic information on a suddenly interrupting vehicle, with a difficulty in a joining to be smooth to a flow of traffic on another lane. Such a problem is not specific to a junction, and may likewise occur at an intersection or in a bad sight where the driving operation becomes relatively difficult.

The present invention has been carried out to solve such a conventional problem, and it therefore is an object of the present invention to provide a vehicular communications apparatus and a vehicular communications method capable of obtaining dynamic information on other vehicles which affect running of own vehicle.

To achieve the object, according to an aspect of the invention, a vehicular communications apparatus, mounted on an own vehicle for radio communications with other vehicles, comprises a memory configured to store information on at least one of a point difficult of a driving operation, an intersection, and a junction, an own vehicle information detector configured to detect information on a position, a velocity, and a moving direction of the own vehicle, an approach decider configured to decide whether the own vehicle has approached the point, intersection, or junction stored in the memory, based on information detected by the own vehicle information detector, an other vehicle information request provider configured to provide requests to other vehicles for information on positions, velocities, and moving directions of the other vehicles, as the own vehicle is decided to have approached the point, intersection, or junction stored in the memory by the approach decider, a calculator configured to calculate relative positions, relative velocities, and relative moving directions between the own vehicle and the other vehicles, respectively, based on information detected by the own vehicle information detector and information returned from the other vehicles in response to the requests from the other vehicle information request provider, a communication opponent searching decider configured to search for, and to decide, other vehicles to be opponents of radio communications, based on information calculated by the calculator, a communication opponent changer configured to change over communication opponents to the other vehicles searched for and decided by the communication opponent searching decider, and a radio communicator configured for radio communications with the communication opponents changed over by the communication opponent changer.

Further, to achieve the object, according to another aspect of the invention, a vehicular communications method for radio communications between an own vehicle and other vehicles comprises storing information on at least one of a point difficult of a driving operation, an intersection, and a junction, detecting information on a position, a velocity, and a moving direction of the own vehicle, deciding whether the own vehicle has approached the stored point, intersection, or junction, based on detected information of the own vehicle, providing requests to other vehicles for information on positions, velocities, and moving directions of the other vehicles, as the own vehicle is decided to have approached the stored point, intersection, or junction, calculating relative positions, relative velocities, and relative moving directions between the own vehicle and the other vehicles, respectively, based on detected information of the own vehicle and information returned from the other vehicles in response to the requests, searching for, and deciding, other vehicles to be opponents of radio communications, based on calculated information, changing over communication opponents to the other vehicles thus searched for and decided; and performing radio communications with the changed communication opponents.

BRIEF DESCRIPTION OF THE ACCOMPANYING DRAWINGS

The above and further objects, features, and advantages of the invention will more fully appear from the detailed description of the preferred embodiments, when the same is read in conjunction with the accompanying drawings, in which:

FIG. 7 is an explanatory view of flags;

FIG. 9A is a schematic explanatory view of an operation of the vehicular communications apparatus according to the second embodiment in an exemplary situation where own vehicle is in communications with a vehicle of an acquaintance or the like;

DETAILED DESCRIPTION OF THE PREFERRED EMBODIMENTS

Figure 1:
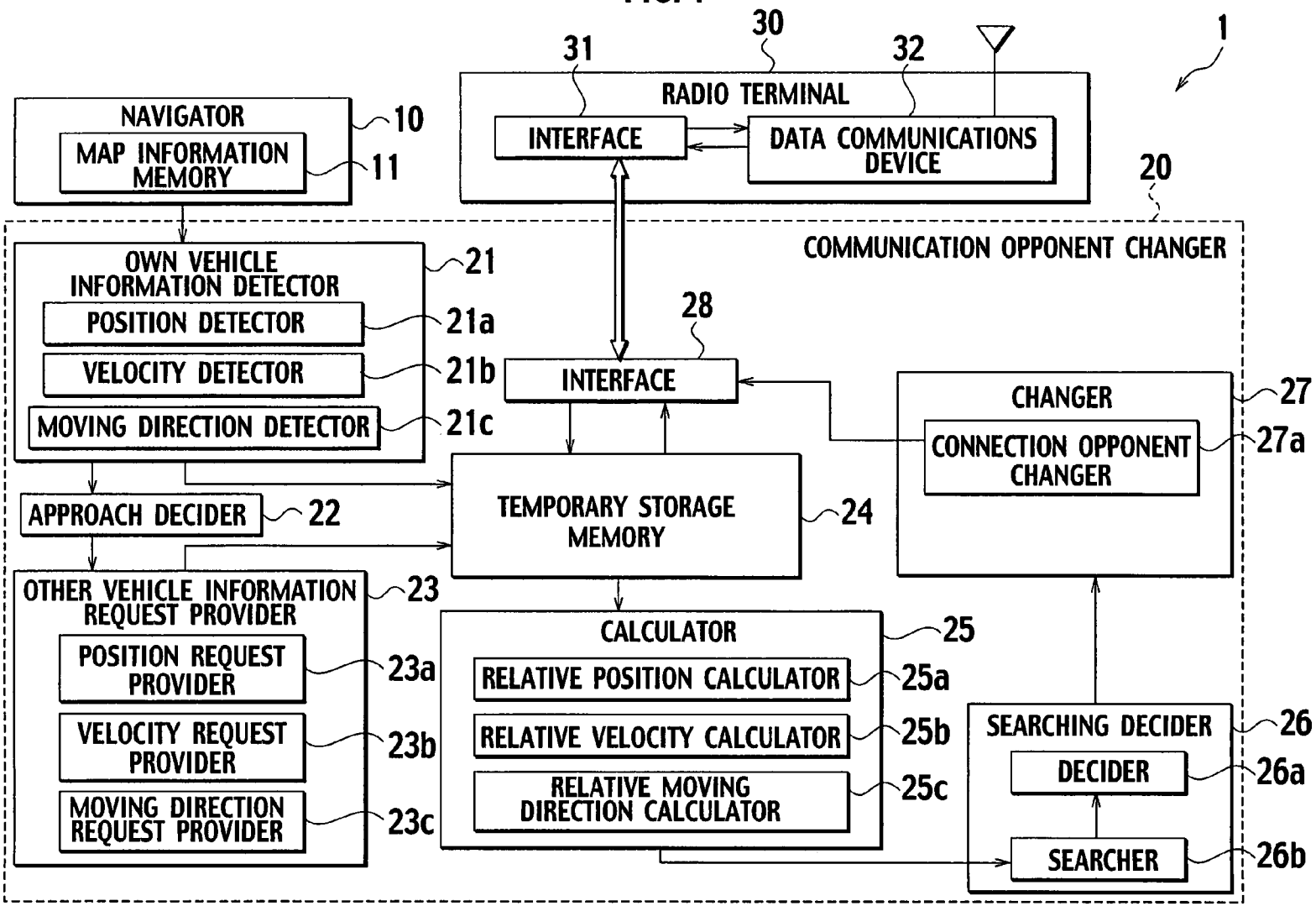
FIG. 1 is a constitutional view of a vehicular communications apparatus according to a first embodiment of the present invention.

There will be explained preferred embodiments of the present invention. In the following embodiments, like members or elements are designated by like reference numerals to eliminate redundancy.

Before explaining a vehicular communications apparatus according to a first embodiment of the present invention, there will be firstly explained importance of obtainment of dynamic information and importance of obtainment of information from other vehicles affecting running of own vehicle at an intersection and a junction.

Generally, it is desirable for own vehicle to smoothly join a flow of traffic at a junction between traffic lanes, so that a driver of own vehicle is to do so while paying attention to other vehicles around own vehicle. However, even when the driver of own vehicle intends to pay attention to other vehicles around own vehicle, it is likely for the driver to delayedly recognize other vehicles or even to fail to recognize them, due to various factors such as deteriorated concentration of the driver after long time driving, or a bad field of view caused by weather.

As such, there can be reduced a frequency of situations where recognition by the driver of own vehicle is delayed or failure of recognition is caused, by conducting communicative connection with other vehicles and by presenting information on them to the driver of own vehicle. Particularly, there will be provided an effect to avoid delayed recognition and to facilitate a smooth joining at a junction, by conducting communicative connection with other vehicles to obtain dynamic information on them in a time-sequential manner and to present the information to the driver of own vehicle.

In this way, it is important to obtain dynamic information on other vehicles at a junction.

However, simply presenting dynamic information on other vehicles fails to sufficiently avoid delayed recognition and to smoothen a joining operation. For example, presenting dynamic information on all other vehicles at a junction to a driver of own vehicle, leads to an excessive amount of information thereby rather deteriorating recognition of the driver. It is thus desirable to present information only about other vehicles which affect running (joining, in case of a junction) of own vehicle, to the driver of own vehicle.

It is thus important to obtain information from other vehicles affecting running of own vehicle, at a junction.

As described above, at a junction, it is important to communicate with other vehicles affecting running of own vehicle and to obtain dynamic information on them. Although there has been described importance at a junction in the above, it is also as important as at a junction, to obtain dynamic information on other vehicles at a point difficult of a driving operation and at an intersection because running of own vehicle may be affected by other vehicles there.

There will be now described a vehicular communications apparatus according to a first embodiment of the present invention.

FIG. 1 is a constitutional view of a vehicular communications apparatus 1 according to the first embodiment. The vehicular communications apparatus 1 shown in FIG. 1 is mounted on own vehicle to radio communicate with another vehicle. Further, vehicular communications apparatus 1 are mounted not only on own vehicle but also on other vehicles, and are each configured to realize inter-vehicular radio communications. Such a vehicular communications apparatus 1 is generally configured with a navigator 10, a communication opponent changer 20, and a radio terminal 30.

The navigator 10 presents information on a guidance path from a position of own vehicle up to an intended point, on a display (not shown), and includes a map information memory 11. The map information memory 11 stores therein map information, together with information on points difficult of a driving operation, intersections, and junctions (hereinafter collectively called "caution points"). Examples of caution points include curved zones of bad visibility, and points of good visibility where slippage is rather frequently caused. Additionally, those points are also embraced where bad fields of view tend to be caused by fog or the like.

The communication opponent changer 20 is configured to break a current communicative connection and change over it to a new one, in a manner to change over the current communicative connection, from another vehicle as a communication opponent of a driver of own vehicle such as an acquaintance with which the driver of own vehicle is voice communicating through VoIP (Voice over Internet Protocol), to another vehicle as a new communication opponent which affects running of own vehicle.

The radio terminal 30 is configured to radio communicate with another vehicle. This radio terminal 30 is controlled by the communication opponent changer 20, in a manner to communicate with another vehicle (such as a vehicle of an acquaintance) as a communication opponent usually desired by the driver of own vehicle, and to communicate with other vehicles as communication opponents affecting running of own vehicle at a caution point.

Based on such a configuration, although the vehicular communications apparatus 1 is in communicative connection with a vehicle of an acquaintance as a usual communication opponent, the vehicular communications apparatus 1 changes over it to other vehicles as communication opponents affecting running of own vehicle when own vehicle has approached a caution point.

Further, since it is important to obtain dynamic information on other vehicles affecting running of own vehicle at a caution point, the vehicular communications apparatus 1 is configured to repetitively obtain information from the other vehicles after changeover of communication opponents and to present the obtained information to a driver of own vehicle from time to time, thereby causing the driver to recognize the dynamic information. Note that the presentation of the information in this case may be conducted on a display or voice output unit (not shown) such as provided in the navigator 10, or may be conducted by a display or voice output unit attached to the vehicular communications apparatus 1.

There will be explained concrete configurations of the communication opponent changer 20 and radio terminal 30. The communication opponent changer 20 includes an own vehicle information detector 21, an approach decider 22, an other vehicle information request provider 23, and a temporary storage memory 24.

The own vehicle information detector 21 is configured to detect a position, a velocity, and a moving direction of own vehicle, and internally includes a position detector 21*a*, a velocity detector 21*b*, and a moving direction detector 21*c*. The position detector 21*a* is configured to detect a position of own vehicle by receiving GPS waves, for example, to obtain own vehicle position information. Further, the velocity detector 21*b* is configured to detect a velocity of own vehicle, by receiving and calculating a pulse signal from a vehicular speed sensor, for example. The moving direction detector 21*c* is configured to detect a moving direction of own vehicle, by obtaining in a time-sequential manner the own vehicle position information obtained by the position detector 21*a*, for example.

The approach decider 22 is configured to decide whether or not own vehicle has approached a caution point stored in the map information memory 11, based on information detected by the own vehicle information detector 21. Concretely, the approach decider 22 is configured to decide whether or not own vehicle has approached the caution point, depending on whether or not the position of own vehicle detected by the own vehicle information detector 21 is within a predetermined distance range from the caution point stored in the map information memory 11. Note that the approach decider 22 may be configured to obtain a time period up to arrival at a caution point by totally deciding the position, velocity, and moving direction of own vehicle, thereby deciding that own vehicle has approached the caution point, based on the obtained time period.

The other vehicle information request provider 23 is configured to provide a request to another vehicle for information on a position, a velocity, and a moving direction of the other vehicle, when the approach decider 22 has decided that own vehicle has approached a caution point stored in the map information memory 11. Further, the other vehicle information request provider 23 includes a position request provider 23*a*, a velocity request provider 23*b*, and a moving direction request provider 23*c*. These position request provider 23*a*, velocity request provider 23*b* and moving direction request provider 23*c* are configured to generate request signals so as to obtain information on a position, velocity, and moving direction of another vehicle, respectively. The request signals generated here are transmitted to another vehicle by the radio terminal 30. When the request signals are received by the other vehicle, it returns information on its position, velocity, and moving direction, and own vehicle is brought to receive the information at the radio terminal 30.

The temporary storage memory 24 is configured to temporarily preserve data, before transmitting and receiving information to and from another vehicle. Further, the temporary storage memory 24 is connected to the own vehicle information detector 21 and other vehicle information request provider 23. Thus, the temporary storage memory 24 is configured to temporarily preserve therein the information on the position, velocity, and moving direction of own vehicle and those of the other vehicle.

Further, the vehicular communications apparatus 1 includes a calculator 25, a searching decider 26, a changer 27, and an interface 28. The calculator 25 is configured to calculate a relative position, a relative velocity, and a relative moving direction between own vehicle and another vehicle, based on information detected by the own vehicle information detector 21 and on information returned from the other vehicle in response to a request from the other vehicle information request provider 23.

Concretely, the calculator 25 includes a relative position calculator 25*a*, a relative velocity calculator 25*b*, and a relative moving direction calculator 25*c*. Among them, the relative position calculator 25*a* is configured to calculate a relative position, by obtaining a difference between a position of own vehicle and a position of another vehicle based on information on them. Similarly to the relative position calculator 25*a*, the relative velocity calculator 25*b* is configured to calculate a relative velocity between own vehicle and another vehicle, by obtaining a velocity difference therebetween. Also, the relative moving direction calculator 25*c* is configured to calculate a relative moving direction between own vehicle and another vehicle, from an angle difference between moving directions of own vehicle and the other vehicle.

The searching decider 26 is configured to search for and decide another vehicle to be opponents of radio communications with own vehicle, based on information calculated by the calculator 25. This searching decider 26 includes a searcher 26*a* configured to search for another vehicle to be an opponent of radio communications with own vehicle based on information calculated by the calculator 25, and a decider 26*b* configured to decide the communication opponent from among searched vehicles.

Concretely, the searcher 26*a* is configured to list other vehicles present within a range narrower than a maximum communicable range, in accordance with a predetermined protocol. Examples of the predetermined protocol include a condition to list other vehicles in a closer order thereof to own vehicle at the present time, and a condition to list other vehicles in an approaching order thereof to own vehicle in the future. In the former case, the searcher 26*a* is to list other vehicles in accordance with the information on relative positions calculated by the calculator 25. In the latter case, the searcher 26*a* is to list other vehicles in an approaching order thereof to own vehicle, based on information on relative velocities and relative moving directions calculated by the calculator 25. The searcher 26*a* may conduct listing, based on both conditions. Namely, the searcher 26*a* may list other vehicles, based on information on relative positions, relative velocities, and relative moving directions calculated by the calculator 25.

Concretely, the decider 26*b* is configured to decide a communication opponent from among other vehicles listed in the above manner. For example, the decider 26*b* decides a first one of the listed other vehicles to be a communication opponent, thereby deciding that one of the listed other vehicles which is closest to own vehicle at the present time or that one of the listed other vehicles which will most closely approach own vehicle in the future, as a communication opponent. Further, the decider 26*b* may decide a plurality of vehicles as communication opponents, such as those ten of the listed other vehicles which are closer to own vehicle at the present time or those ten of the listed other vehicles which will approach own vehicle closer thereto in the future.

The changer 27 is configured to change over a communication opponent to another vehicle searched for and decided by the searching decider 26. Namely, the changer 27 is configured to change over a communication opponent to a first one of the listed other vehicles or to highly ranked ones of them. Further, the changer 27 includes a connection opponent changer 27*a*. This connection opponent changer 27*a* is configured to generate information on a communicative connection request so as to execute changeover of a communication opponent, and to transmit this information to the communication opponent via radio terminal 30.

The interface 28 is configured to be connected with the radio terminal 30 which also includes an interface 31, so that the communication opponent changer 20 and radio terminal 30 are connected with each other by these interfaces.

The radio terminal 30 is capable of communicating with the communication opponent changer 20 such as via cellular phone communications, wireless LAN (802.11a, 802.1b, 802.1g or the like), or DSRC. Concretely, the radio terminal 30 is configured to be connected with the communication opponent changer 20, via radio communications such as Bluetooth or infrared (IrDA), or wire communications such as RS-232C (serial interface), USB (Universal Serial Bus), or UART (universal asynchronous receiver transmitter).

Further, the radio terminal 30 includes a data communications device 32 in addition to the interface 31. The data communications device 32 functions as a main device for transmitting and receiving data, and is configured to be powered upon turning on an ignition switch of own vehicle. Note that the data communications device 32 may be configured to internally include a small-sized battery so as to constantly keep an ON state. In this case, the data communications device 32 is desirably configured to charge the small-sized battery during running of own vehicle, so as to avoid consumption of the small-sized battery.

Figure 2A:
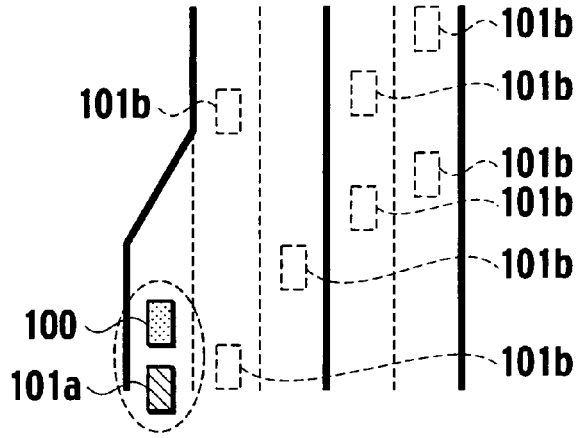
FIG. 2A is a schematic explanatory view of operation of the vehicular communications apparatus according to the first embodiment in an initial state.
Figure 2B:
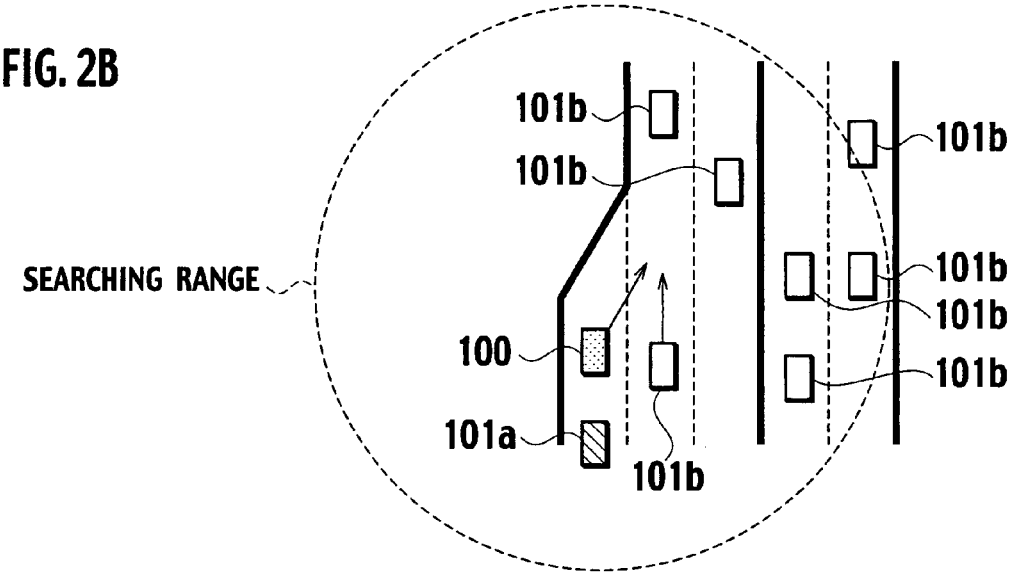
FIG. 2B is a similar schematic explanatory view in a searching situation.
Figure 2C:
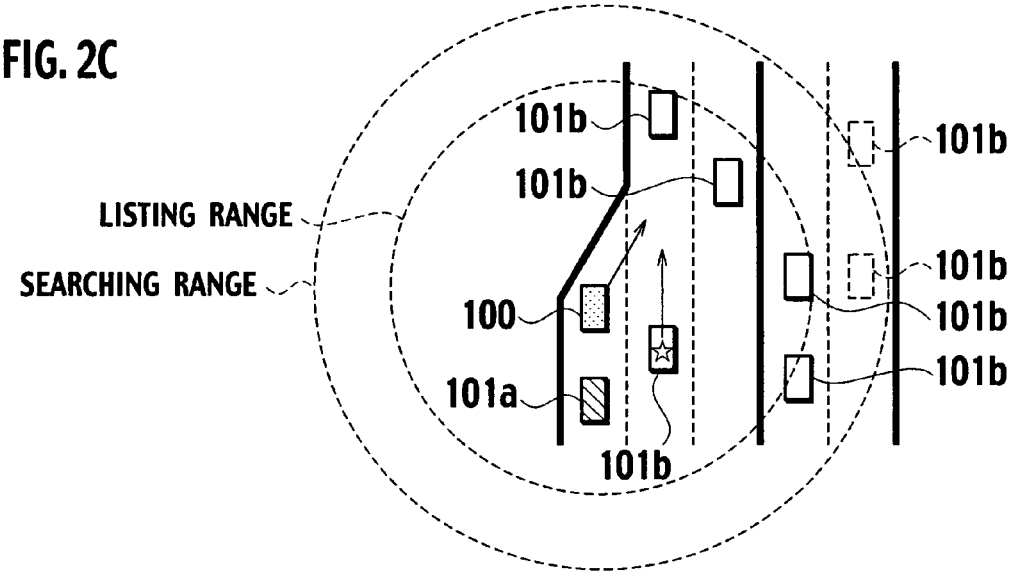
FIG. 2C is a similar schematic explanatory view in a listing situation.

In the vehicular communications apparatus 1 as described above, the following operation is conducted. FIG. 2A is a schematic explanatory view of operation of the vehicular communications apparatus 1 according to the first embodiment in an initial state, FIG. 2B is a similar schematic explanatory view in a searching situation, and FIG. 2C is a similar schematic explanatory view in a listing situation.

As shown in FIG. 2A, it is firstly assumed that own vehicle 100 has approached a junction, in a state where own vehicle 100 is exemplarily in voice communications with another vehicle 101*a* of an acquaintance through VoIP. At this time, present around own vehicle 100 are many other vehicles 101*b* which are not in radio communications with own vehicle 100.

In such a situation, the vehicular communications apparatus 1 conducts the following operation. Namely, the own vehicle information detector 21 detects a position, velocity, and moving direction of own vehicle. Then, the approach decider 22 decides whether or not own vehicle has approached a junction, based on information detected by the own vehicle information detector 21.

At this time, the approach decider 22 decides whether or not own vehicle is within a range of 30 m from a junction, based on the positional information on own vehicle and the information on the junction stored in the map information memory 11, for example. This allows to decide whether or not own vehicle has approached the junction. However, accuracy may be lost, insofar as based on comparison of the junction with the positional information only. For example, even when own vehicle is at a distance less than 30 m to the junction, a time period required to reach the junction in case of velocity of several kilometers/hour is considerably different from that in case of velocity of about 100 km/h. As such, the approach decider 22 also decides whether or not such a time period is within 5 seconds up to arrival at the junction, in consideration of the velocity and moving direction of own vehicle. This enables the approach decider 22 to decide approaching, in a more accurate manner. Further, the approach decider 22 may change the above-described values of 30 m and 5 seconds to 1 km and 10 seconds, respectively, when own vehicle is running on an expressway.

Thereafter, the other vehicle information request provider 23 provides requests to other vehicles for information on positions, velocities, and moving directions of them, when the approach decider 22 has decided that own vehicle has approached a junction. At this time and as shown in FIG. 2B, the radio terminal 30 of own vehicle 100 transmits request signals to other vehicles 101*b*, respectively, which are positioned within a searching range (i.e., a maximum radio communicable range) and which have not been in communications with own vehicle. When the vehicles 101*b* have received the request signals, these vehicles 101*b* return information on positions, velocities, and moving directions thereof, respectively. Then, the radio terminal 30 of own vehicle 100 receives these information.

Note that although own vehicle 100 radio communicates with the vehicles 101*b* as described above, this communication is of a temporary nature. Thus, although own vehicle 100 obtains positions, velocities, and moving directions of the vehicles 101*b*, own vehicle 100 does not continuously communicate with them so that own vehicle 100 does not obtain dynamic information on them. Namely, the communication is conducted here in a manner to specify those vehicles which affect running of own vehicle, so as to obtain dynamic information in a later procedure.

Thereafter, the calculator 25 calculate relative positions, relative velocities, and relative moving directions among own vehicle and other vehicles, respectively, based on information detected at the own vehicle information detector 21 and the information returned from the other vehicles in response to the requests from the other vehicle information request provider 23.

Then, the searching decider 26 searches for and decides those ones of the other vehicles which are to be opponents of radio communications with own vehicle, based on information calculated by the calculator 25. At this time and as shown in FIG. 2C, the searcher 26*a* lists those ones of the other vehicles which present within a range (listing range) narrower than the maximum communicable range, in accordance with a predetermined protocol.

Namely, the decider 26*b* lists only those vehicles 101*b* (represented by solid lines in FIG. 2C) present within the listing range, and does not list those vehicles 101*b* (represented by broken lines in FIG. 2C) present outside the listing range. Further, the searcher 26*a* lists the vehicles 101*b* based on a predetermined protocol, i.e., lists those vehicles in a closer order thereof to own vehicle at the present time, or lists those vehicles in an approaching order thereof to own vehicle in the future.

After listing, the decider 26*b* decides a communication opponent from among the above listed other vehicles. At this time, the decider 26*b* decides, as a communication opponent or communication opponents, that one of the listed other vehicles which is closest to own vehicle at the present time, that one of the listed other vehicles which will most closely approach own vehicle in the future, those ones of the listed other vehicles which are closer to own vehicle at the present time, or those ones of the listed other vehicles which will more closely approach own vehicle in the future. After decision, the changer 27 changes over to that one of the listed other vehicles, which has been searched for and decided by the searching decider 26.

Thereafter, the data communications device 32 of the radio terminal 30 sequentially obtains information from each communication opponent as changed over. Then, the obtained information is presented to a driver of own vehicle from time to time, so that the driver is brought to recognize dynamic information. For example, when a communication opponent is changed over to the vehicle 101*b* accompanied by a star mark in FIG. 2C, information is obtained from the vehicle 101*b* in a time-sequential manner, and the information is sequentially presented to the driver of own vehicle, thereby enabling the driver of own vehicle to smoothly join a flow of traffic.

Figure 3:
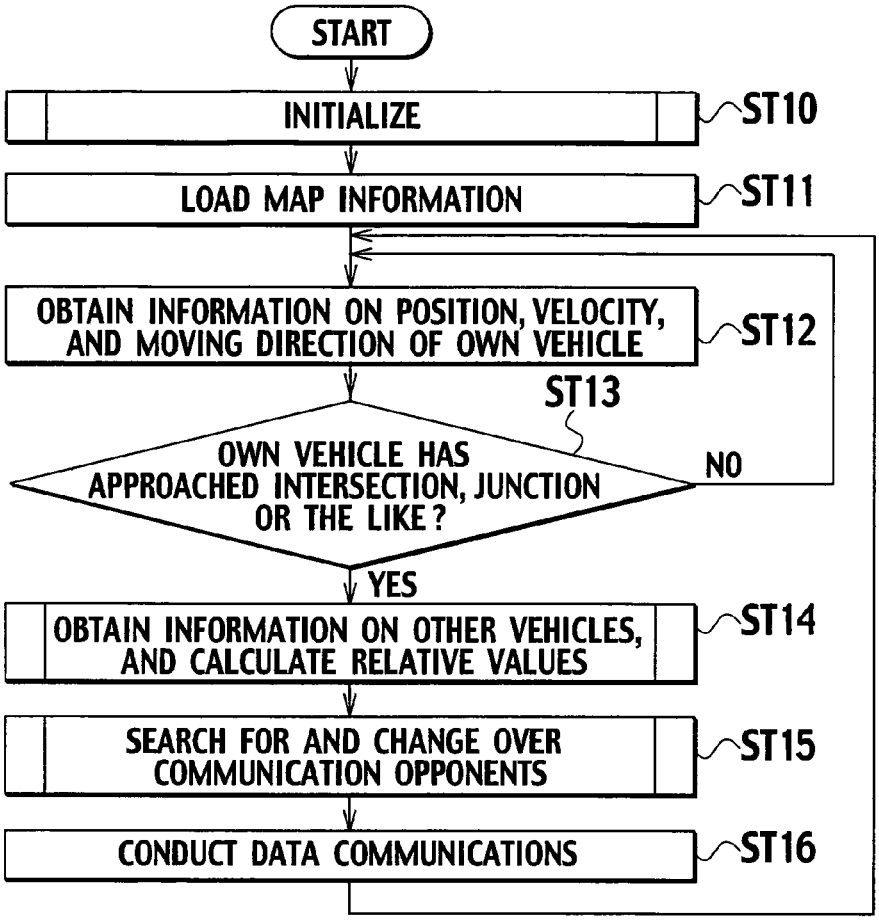
FIG. 3 is a flowchart of an exemplary operation of the vehicular communications apparatus according to the first embodiment.

There will be explained detailed procedures of the vehicular communications apparatus 1. FIG. 3 is a flowchart of an exemplary operation of the vehicular communications apparatus 1 according to the first embodiment.

Figure 4:
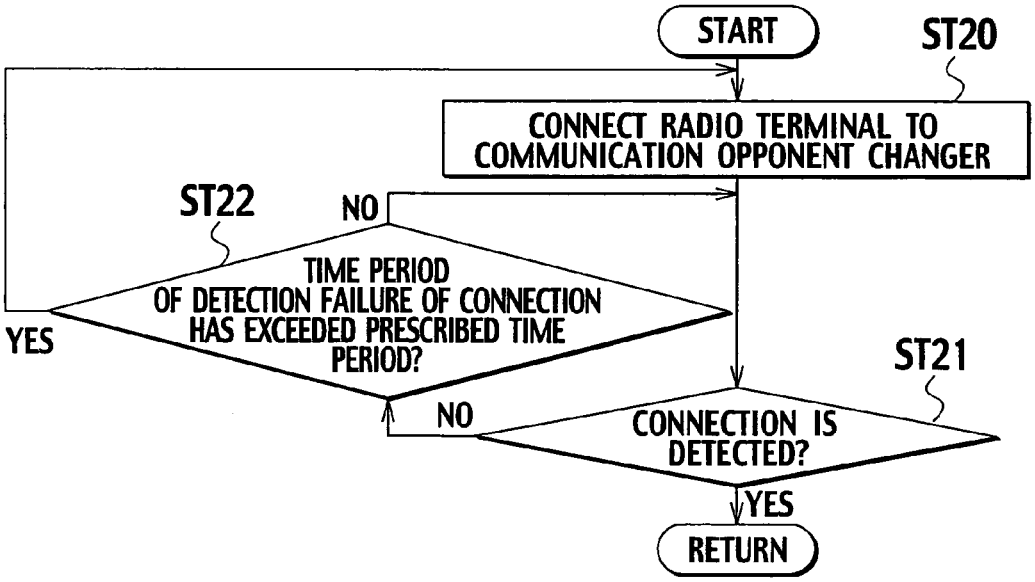
FIG. 4 is a flowchart of detailed procedures at step ST10 of FIG. 3.

As shown in this flowchart, the apparatus 1 conducts initialization (step ST10). FIG. 4 is a flowchart of detailed procedures at step ST10 of FIG. 3. As shown in this flowchart, the radio terminal 30 is connected to the communication opponent changer 20 upon initialization (ST20). This connection procedure may be automatically conducted upon turning on an ignition switch, or may be conducted manually.

Example of manual operation is to connect the communication opponent changer 20 and radio terminal 30 with each other, or to provide them with switches, respectively, which are manually operated to conduct a specific operation. It is also possible to omit a connecting operation, by integrating the communication opponent changer 20 and radio terminal 30 with each other at the time of shipment.

After the connecting operation, it is decided whether or not the communication opponent changer 20 and radio terminal 30 are connected with each other (ST21). At this time, the communication opponent changer 20 transmits an electrical signal (such as AT command) to the radio terminal 30, for example, to decide whether or not a response is present.

Here, when it is decided that connection is not detected (ST21: NO), the communication opponent changer 20 decides whether or not the time period of detection failure of connection has exceeded a prescribed time period (step ST22). When it is decided that the prescribed time period has been exceeded (ST22: YES), the flow returns to step ST20 to conduct the connecting operation again.

Meanwhile, when it is decided that the prescribed time period has not been exceeded (ST22: NO), the flow returns to step ST21 to decide again whether or not the connection is established. Contrary, when it is decided that the connection is detected (ST21: YES), the flow returns to step ST11. At this time, the communication opponent changer 20 causes a driver of own vehicle to recognize establishment of connection, by displaying a connection message on a display or by producing a sound at a voice output unit.

Reverting to FIG. 3, the own vehicle information detector 21 loads map information from the map information memory 11 (ST11) after initialization. Namely, the own vehicle information detector 21 reads out information on caution points from the map information memory 11, and sends the readout information to the approach decider 22 thereby making the information available.

Thereafter, the own vehicle information detector 21 detects information on a position, a velocity, and a moving direction of own vehicle (ST12). After detection, the own vehicle information detector 21 sends the detected information to the approach decider 22.

Thereafter, the approach decider 22 decides whether or not own vehicle has approached a caution point (ST13). When it is decided that own vehicle is not approaching, (ST13: NO), the own vehicle information detector 21 is brought to again detect a position, velocity, and moving direction of own vehicle.

Figure 5:
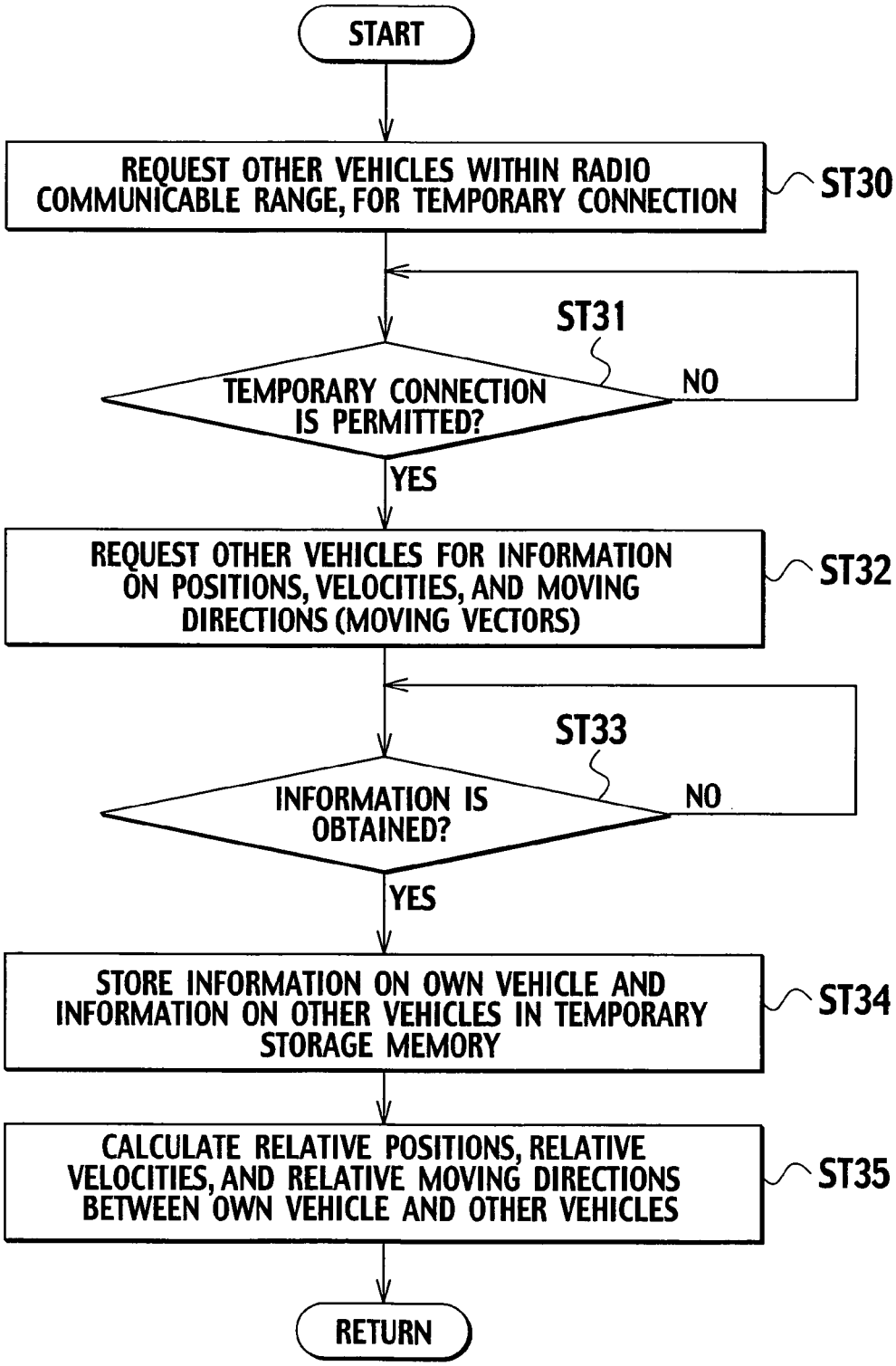
FIG. 5 is a flowchart of detailed procedures at step ST14 of FIG. 3.

Meanwhile, when it is decided that own vehicle has approached (ST13: YES), there are conducted obtainment of information on other vehicles and calculation of relative information, i.e., relative positions, relative velocities, and relative moving directions between own vehicle and the other vehicles (ST14). FIG. 5 is a flowchart of detailed procedures at step ST14 of FIG. 3. In conducting the procedures at step ST14, the radio terminal 30 firstly requests other vehicles within a radio communicable range (i.e., the searching range shown in FIG. 2B) for temporary connection (ST30). Concretely, the radio terminal 30 looks up information (MAC addresses) about vehicular communications apparatus 1 mounted on the other vehicles, respectively, communication channels thereof, and the like, and requests the other vehicles for temporary connection in accordance with the looked up MAC addresses, the communication channels, and the like.

Thereafter, the communication opponent changer 20 decides whether or not temporary connection is permitted by each of the other vehicles (ST31). When it is decided that temporary connection is not permitted (ST13: NO), this procedure is repeated until decision of permission. Meanwhile, when it is decided that temporary connection is permitted (ST31: YES), the other vehicle information request provider 23 generates request signals. Then, the radio terminal 30 transmits the request signals to those ones of the other vehicles which are permitting temporary connection, respectively (ST32).

Thereafter, the communication opponent changer 20 decides whether or not the information on positions and the like of the permitting other vehicles have been obtained (ST33). When it is decided that the information on the positions and the like of the permitting other vehicles are not obtained (ST33: NO), the communication opponent changer 20 repeats this procedure until obtainment of the information.

Meanwhile, when it is decided that the information on positions and the like of the permitting other vehicles have been obtained (ST33: YES), the communication opponent changer 20 stores, into the temporary storage memory 24, the information on the position and the like of own vehicle, and the information on the positions and the like of the permitting other vehicles (ST34). Thereafter, the calculator 25 calculates the relative positions, relative velocities, and relative moving directions, based on the information stored in the temporary storage memory 24 (ST35). Then, the flow goes to step ST15 shown in FIG. 3.

Figure 6:
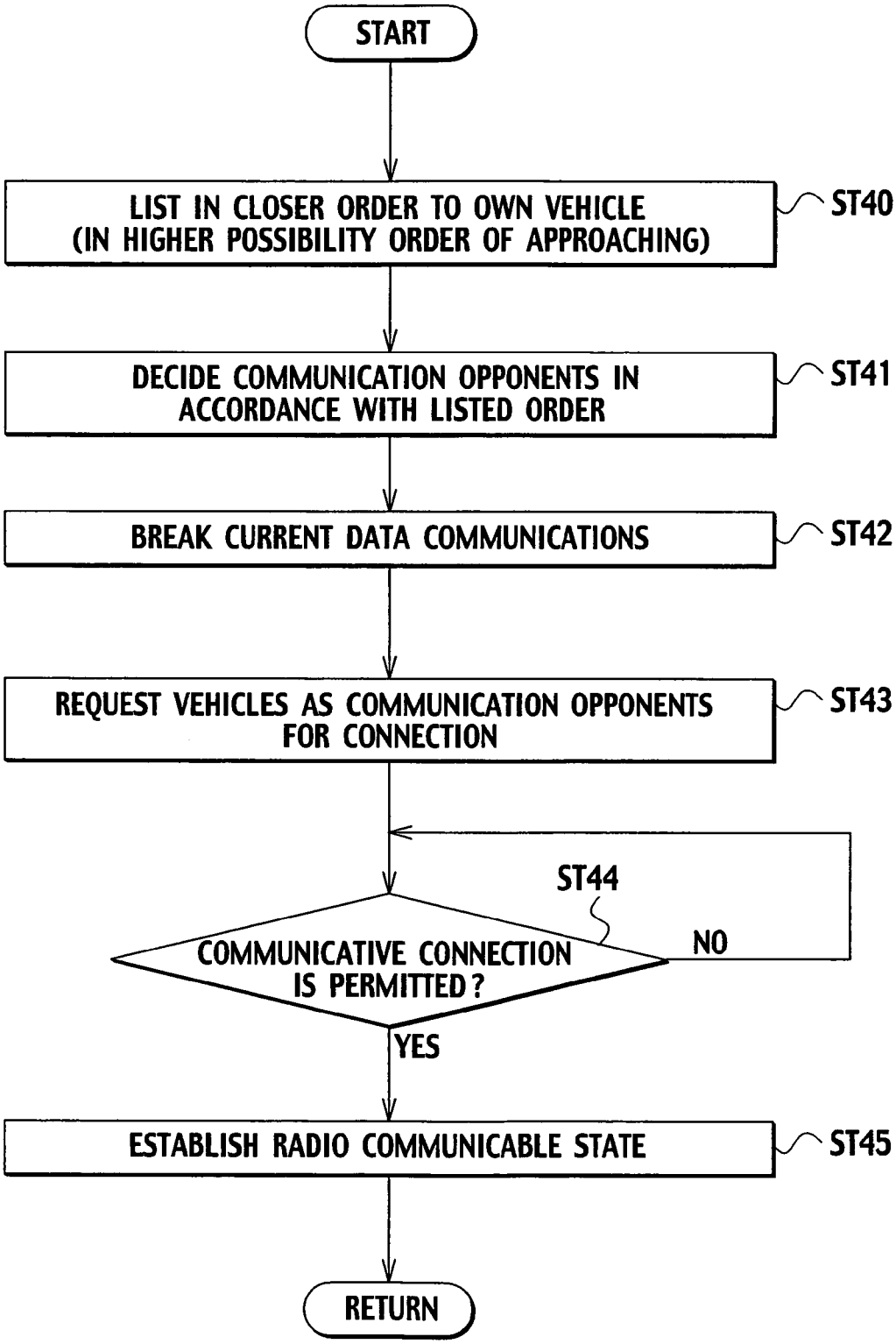
FIG. 6 is a flowchart of detailed procedures at step ST15 of FIG. 3.

Reverting to FIG. 3, the searching decider 26 searches for and decides communication opponents (ST15), after the above procedures. FIG. 6 is a flowchart of detailed procedures at step ST15 of FIG. 3.

As shown in FIG. 6, the searcher 26*a* firstly lists other vehicles in a closer order thereof to own vehicle at the present time (ST40), in searching for and deciding communication opponents. Here, there are listed only those ones of the other vehicles, which are present within the listing range. Further, without restricted to listing of other vehicles in a closer order thereof to own vehicle at the present time, it is possible to list other vehicles in an approaching order thereof to own vehicle in the future.

Thereafter, the decider 26*b* decides communication opponents in accordance with the listed order (ST41). Then, the radio terminal 30 breaks currently conducted data communications with another vehicle (ST42). Namely, when own vehicle is in communications with another vehicle of an acquaintance or the like such as through VoIP, the communications are to be broken. Although the breakage is conducted by transmitting a breaking command to the other vehicle of the acquaintance, the communication may be forcibly broken when the same can not be broken by command transmission.

Then, the connection opponent changer 27*a* generates information on communicative connection requests for executing changeover of communication opponents, and causes the radio terminal 30 to transmit these information to communication opponents (ST43). Thereafter, the communication opponent changer 20 decides whether or not each communicative connection is permitted or not (ST44). Here, when it is decided that the communicative connection is not permitted (ST44: NO), this procedure is repeated until decision of permission of communicative connection.

Meanwhile, when it is decided that the communicative connection is permitted (ST44: YES), the communication opponent changer 20 opens a communication port to be used, and establishes a radio communicable state (ST45). Then, the flow returns to step ST16 shown in FIG. 3.

Thereafter, the radio terminal 30 conducts data communications (ST16). Namely, the radio terminal 30 obtains information from communication opponents by radio communications in a time-sequential manner, and presents the obtained information to a driver of own vehicle from time to time. This causes the driver of own vehicle to recognize dynamic information on the other vehicles affecting running of own vehicle.

For example, obtainment and presentation of information is conducted until joining of own vehicle to a flow of traffic at a junction, and the processing flow returns to step ST12 after joining. The above procedures are repeated until the ignition switch of own vehicle is turned off, for example.

The above operation enables to change over a communication opponent of own vehicle, from another vehicle in connection with own vehicle, to other vehicles suitable in a situation where own vehicle is encountering the other vehicles at a caution point, for example.

In this way, it is decided by the vehicular communications apparatus 1 according to the first embodiment, that own vehicle has approached one of a point difficult of a driving operation, an intersection, and a junction, and positional information and the like of other vehicles are obtained in case of decision of approaching. This allows a driver of own vehicle to obtain positional information and the like of the other vehicles, in a situation where the driver of own vehicle wishes to recognize dynamic information on the other vehicles.

Further, relative positions and the like are calculated based on the obtained positional information and the like of other vehicles and positional information and the like of own vehicle, and those ones of the other vehicles which are to be opponents of radio communications are searched for and decided based on the calculated information. Here, the other vehicles required to be opponents of communications with own vehicle are not all ones around own vehicle, but those ones which affect running of own vehicle. Thus, in this embodiment, there are searched for and decided those of other vehicles which affect running of own vehicle by calculating relative positions and the like, except for those which do not affect running of own vehicle.

Further, the communication opponent of own vehicle is changed over to the other vehicles searched for and decided in the above manner, so that communicative connection of own vehicle is conducted with the other vehicles around own vehicle which affect running of own vehicle. Then, information is obtained via radio communications from the communicatively connected other vehicles while conducting information obtainment in a time-sequential manner, thereby enabling obtainment of dynamic information on the communicatively connected other vehicles which affect running of own vehicle.

This enables to obtain dynamic information on the other vehicles affecting running of own vehicle.

Moreover, there are listed the other vehicles present within a range narrower than a maximum communicable range. This allows to readily exclude other vehicles which are located farther from own vehicle, i.e., those which do not affect running of own vehicle, thereby enabling effective decision of communication opponents.

In turn, the other vehicles are listed in a closer order thereof to own vehicle based on relative positions, so that the other vehicles are listed in an order to more affect running of own vehicle at the present time. This enables decision of communication opponents with a good efficiency.

Alternatively or simultaneously with the above, the other vehicles are listed in an approaching order thereof to own vehicle based on relative velocities and relative moving directions, so that the other vehicles are listed in an order to more affect running of own vehicle in the future. This enables decision of communication opponents with a good efficiency.

There will be explained a vehicular communications apparatus 2 according to a second embodiment of the present invention. This apparatus 2 is basically the same as that of the first embodiment, except for partial configuration and procedure different from those of the first embodiment.

There will be explained the vehicular communications apparatus 2 according to the second embodiment. Firstly, this second embodiment utilizes flags for transmission and receipt of information between own vehicle and other vehicles. FIG. 7 is an explanatory view of flags. As shown in FIG. 7, each information has attribution flags to be determined for a secrecy degree and a running importance level, respectively.

Concretely, positional information, velocity information, and moving direction information have values "0" in secrecy degree flags thereof, respectively, and individual authentication information and VoIP-based voice information have values "1" in secrecy degree flags thereof, respectively. Here, those information having values "1" in secrecy degree flags are related to individual privacy, and those information having values "0" in secrecy degree flags are not related to privacy.

Further, when information having a value "1" in its secrecy degree flag is received in this embodiment, the information is not obtained, without storing the information in the temporary storage memory 24. Namely, this embodiment is configured to obtain only those information having values "0" in secrecy degree flags thereof, respectively, and to store them in the temporary storage memory 24. This avoids invasion of privacy, upon obtainment of dynamic information.

Moreover and concretely, individual authentication information and DVD image have values "0" in running importance level flags thereof, respectively, and positional information, velocity information, moving direction information, and camera image have values "1" in running importance level flags thereof, respectively. Here, those information having values "1" in running importance level flags thereof are to be obtained from other vehicles at a caution point, and those information having values "0" in running importance level flags thereof have lower necessity levels of obtainment at caution points, respectively.

Furthermore, this embodiment is configured to request those information having values "1" in running importance level flags thereof and not to request those information having values "0" in running importance level flags thereof, respectively, upon transmitting request signals at a caution point. This enables obtainment of suitable information at a caution point.

Figure 8:
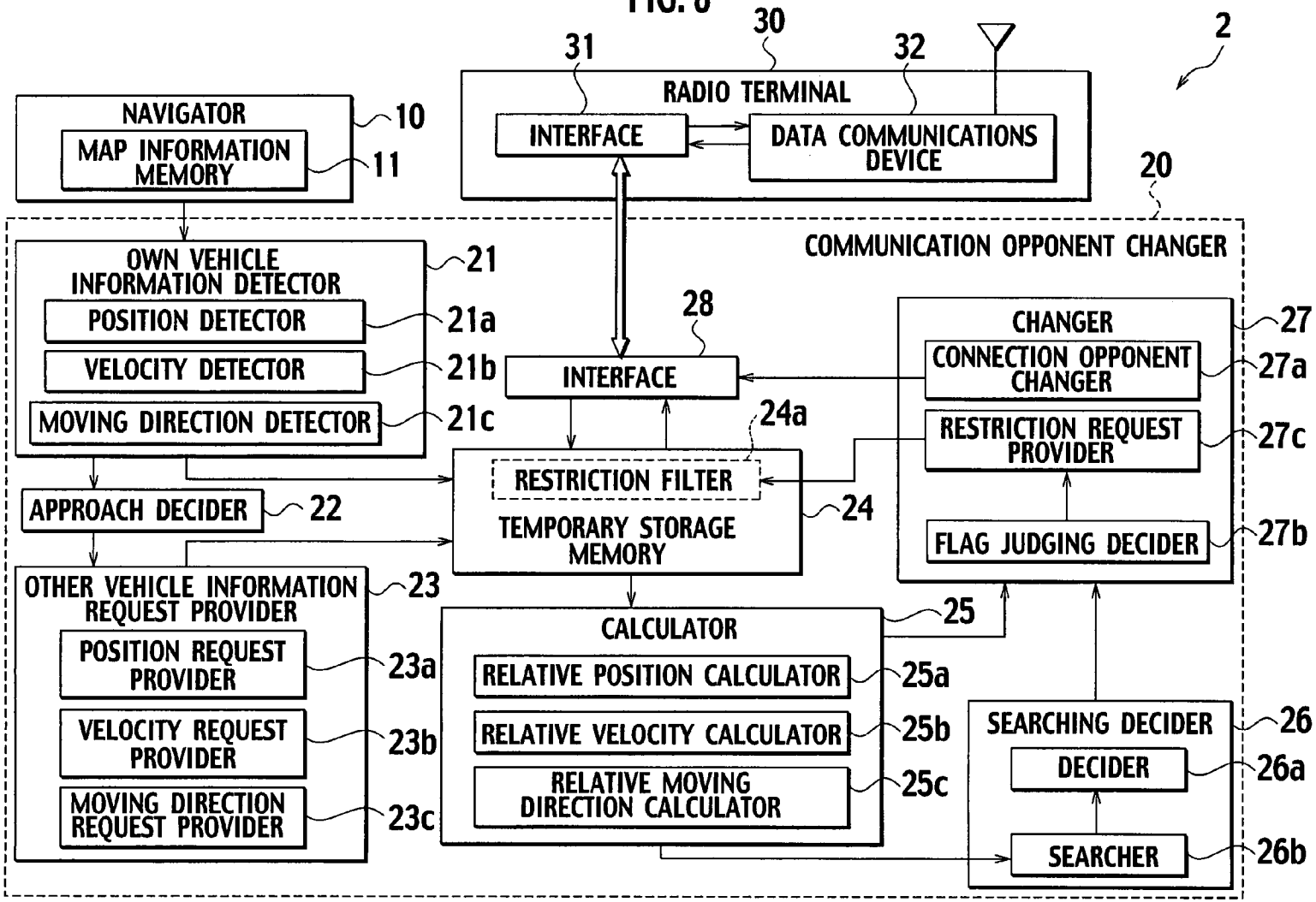
FIG. 8 is a constitutional view of a vehicular communications apparatus according to a second embodiment of the present invention.

There will be explained a configuration of the vehicular communications apparatus 2 according to the second embodiment. FIG. 8 is a constitutional view of the vehicular communications apparatus 2 according to the second embodiment. In the second embodiment, the changer 27 internally includes a flag judging decider 27*b* and a restriction request provider 27*c*. Further, the temporary storage memory 24 internally includes a restriction filter 24*a*.

Firstly, the flag judging decider 27*b* is configured to judge flags of received information, and to decide availability of the information based on the flags. Namely, the flag judging decider 27*b* is configured to judge flags of information to thereby decide whether or not individual authentication information and the like have been received.

The restriction request provider 27*c* is configured to control the restriction filter 24*a*. The restriction filter 24*a* is configured to restrict information which is received by the radio terminal 30 and is to be obtained by own vehicle. Namely, when the radio terminal 30 has received positional information on another vehicle and individual authentication information on a driver of the other vehicle, the restriction filter 24*a* of own vehicle restricts obtainment of the individual authentication information without restricting obtainment of the positional information.

Further, the changer 27 is configured to decide information to be obtained, based on running importance level flags. Furthermore, the changer 27 is configured to request another vehicle to return information to be obtained, upon deciding such information. Thus, even when information of DVD image is being obtained, it is possible to obtain positional information or the like by changing types of information to be requested to another vehicle.

Figure 9A:
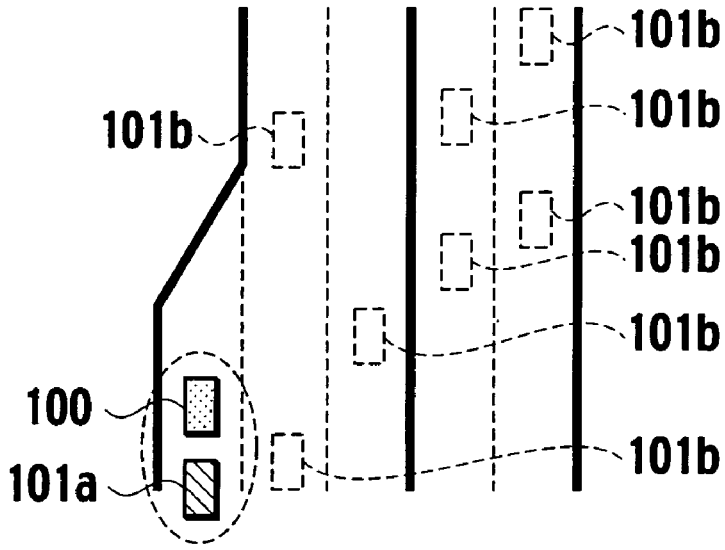
Figure 9B:
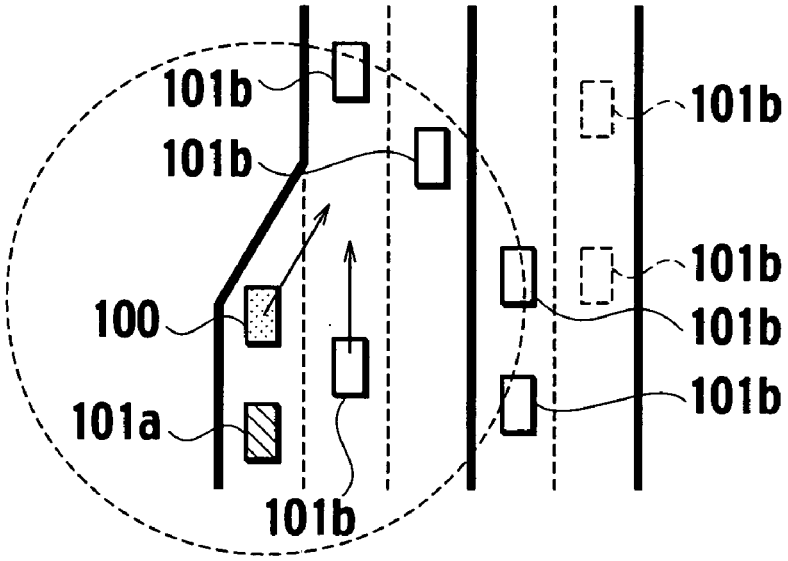
FIG. 9B is a similar schematic explanatory view of a situation where own vehicle is in communications with other vehicles affecting running of own vehicle.

FIG. 9A is a schematic explanatory view of an operation of the vehicular communications apparatus 2 according to the second embodiment in an exemplary situation where own vehicle is in communications with a vehicle of an acquaintance or the like, and FIG. 9B is a similar schematic explanatory view of a situation where own vehicle is in communications with other vehicles affecting own vehicle.

As shown in FIG. 9A, it is assumed that own vehicle 100 is in voice communications with another vehicle 101*a* of an acquaintance through VoIP. At this time, since drivers of own vehicle 100 and the other vehicle 101*a* are acquainted with each other, for example, it is not so required to consider privacy or the like. Thus, the restriction filter 24*a* does not restrict information to be obtained.

Further, in the example shown in FIG. 9A, since own vehicle has not approached a junction, it is not so required to consider running importance levels of information. Thus, the voice communications through VoIP are continued, without changing types of information to be requested to the other vehicle.

Turning to FIG. 9B, when own vehicle is assumed to be approaching a junction, necessity is lowered for obtainment of voice information through VoIP. Thus, the changer 27 of own vehicle changes over types of information to be requested for obtainment, from voice information through VoIP to positional information or the like. Concretely, assuming a flag threshold value of "0.5" for running importance level flags, the changer 27 changes over types of information, so as to obtain those information having values in running importance level flags thereof which are larger than the flag threshold value.

In the above, the changer 27 does not change over the types of information in a manner to obtain all information having values in running importance level flags thereof which are larger than the flag threshold value, i.e., in a manner to obtain positional information, velocity information, moving direction information, and camera image information, but the changer 27 changes over types of information to be requested, based on relative positions calculated by the calculator 25. For example, the changer 27 changes over types of information to be requested for obtainment, so as to obtain more information from other vehicles relatively closer to own vehicle in position and to obtain a minimum amount of information from other vehicles relatively farther from own vehicle. Namely, since the other vehicles relatively closer to own vehicle in position tend to affect smooth joining, the changer 27 requests them for four types of information on position, velocity, moving direction, and camera image, while requesting the other vehicles relatively farther in position from own vehicle for positional information only.

Without limited to the above, the changer 27 may be configured to change over types of information to be requested to other vehicles for obtainment, based on the positional information on own vehicle and map information obtained by the own vehicle information detector 21. This enables the changer 27 to change over types of information to be requested for obtainment, correspondingly to a running area of own vehicle. For example, since vehicular speeds are high on an expressway, it is difficult for a driver to suitably refer to a display even when information is displayed thereon. Thus, the changer 27 changes over types of information so as to request a minimum amount of information in a sense to reduce an amount of information so that a driver of own vehicle readily recognizes dynamic information on other vehicles.

Further, the changer 27 may be configured to change over types of information to be requested to other vehicles for obtainment, based on at least one of relative velocities calculated by the calculator 25 and velocity information on own vehicle obtained by the own vehicle information detector 21. When particular ones of the other vehicles have higher relative velocities, such particular vehicles may suddenly approach own vehicle. Thus, the changer 27 changes over types of information so as to request such particular vehicles for four types of information on position, velocity, moving direction, and camera image, while requesting the remainder of the other vehicles for positional information only. In turn, when own vehicle has a higher velocity, the changer changes types of information so as to request a minimum amount of information so that a driver of own vehicle readily recognizes dynamic information on the other vehicles, similarly to the above-mentioned case of expressway running.

In this way, the changer 27 is allowed to obtain suitable information corresponding to a running situation. It is now assumed that individual authentication information has been transmitted to own vehicle from another vehicle 101*b*, other than those information to be required. In this case, the restriction filter 24*a* restricts obtainment of the individual authentication information, so as to protect privacy of a driver of the other vehicle 101*b*. Concretely, assuming a flag threshold value of "0.5" for secrecy degree flags, the restriction filter 24*a* refuses obtainment of individual authentication information and the like having values in secrecy degree flags thereof larger than the flag threshold value.

Figure 10:
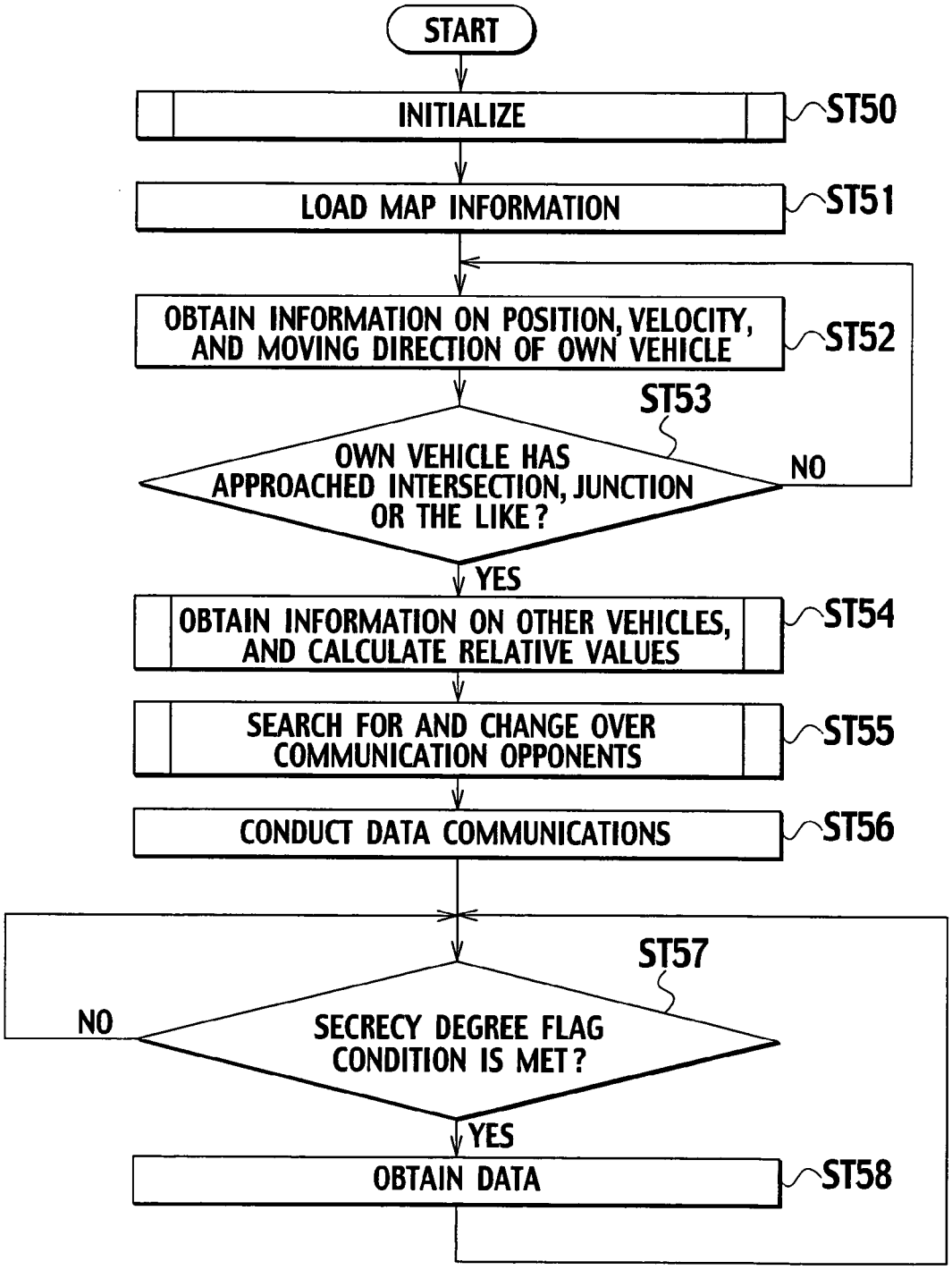
FIG. 10 is a flowchart of an exemplary detailed operation of the vehicular communications apparatus according to the second embodiment.

There will be explained detailed procedures of the vehicular communications apparatus 2 according to the second embodiment. FIG. 10 is a flowchart of an exemplary detailed operation of the vehicular communications apparatus 2 according to the second embodiment. Note that procedures at step ST50 through step ST55 in FIG. 10 are the same as those at step ST10 through step ST15 in FIG. 3, so that explanation of the former shall be omitted.

As shown in FIG. 10, the radio terminal 30 conducts radio communications (ST56) after completing procedures at steps ST50 through step ST55 identically to the first embodiment. At this time, the radio terminal 30 obtains those information each having a flag value "1" in a running importance level flag thereof. Namely, even when information of DVD image has been received, changeover is conducted to receive positional information and the like, and transmission/reception of data is conducted after the changeover. At this time, the radio terminal 30 changes over to information to be obtained, based on relative positions, relative velocities, and the like in accordance with an instruction from the changer 27, and conducts transmission/reception of data after the changeover.

Thereafter, the flag judging decider 27*b* judges whether or not a secrecy degree flag condition is met (ST57). Namely, the flag judging decider 27*b* judges whether or not individual authentication information or the like is being received.

Here, when it is decided that the flag condition is not met (ST57: NO), the restriction request provider 27*c* controls the restriction filter 24*a* to thereby refuse obtainment of information. Contrary, when it is decided that the flag condition is met (ST57: YES), the restriction filter 24*a* does not refuse obtainment of information and the temporary storage memory 24 stores the received information.

The above operation enables to avoid invasion of privacy of a driver of another vehicle, when own vehicle encounters the other vehicle at a caution point, for example.

Although obtainment of information has been restricted from both standpoints of secrecy degree and running importance level in the above, it is possible to restrict obtainment of information from one of these standpoints. Further, although the flags have been set by using two values of "0" and "1" in the above, it is possible to use three, four or more values.

In this way, the vehicular communications apparatus 2 according to the second embodiment enables obtainment of dynamic information on other vehicles affecting running of own vehicle identically to the first embodiment, thereby enabling to decide communication opponents with a good efficiency.

Further, the second embodiment restricts obtainment by own vehicle of information received from other vehicles, thereby enabling to avoid invasion of privacy.

Moreover, types of information to be requested to other vehicles for obtainment are changed over, based on calculated relative positions. This allows to request other vehicles having closer relative positions for many information on position, velocity, and moving direction because they tend to affect smooth joining, and to request other vehicles having farther relative positions for positional information only. In this way, it becomes possible to obtain suitable information corresponding to a running situation.

Furthermore, types of information to be requested to other vehicles for obtainment are changed over, based on positional information on own vehicle and map information. This allows to decide information to be obtained, correspondingly to a running area of own vehicle. For example, since vehicular speeds are high on an expressway, it is difficult for a driver to suitably refer to a display even when information is displayed thereon. Nonetheless, it becomes possible to request a minimum amount of information in a sense to reduce an amount of information so that a driver of own vehicle readily recognizes dynamic information on other vehicles. This enables to obtain suitable information corresponding to a running situation.

Further, types of information to be requested to other vehicles for obtainment are changed over based on at least one of calculated relative velocities and a velocity of own vehicle. For example, when particular ones of the other vehicles have higher relative velocities, such particular vehicles may suddenly approach own vehicle. Thus, it is possible to change over types of information so as to request such particular vehicles for many information such as about position, velocity, and moving direction, while requesting the remainder of the other vehicles for positional information only. In turn, when own vehicle has a higher velocity, it is possible to request a minimum amount of information so that a driver of own vehicle readily recognizes dynamic information on other vehicles, similarly to a situation of expressway running.

In this way, it becomes possible to obtain suitable information corresponding to a running situation.

Further, information to be transmitted and received via radio communications between own vehicle and other vehicles are judged by flags. This enables to readily judge whether or not the information leads to invasion of privacy, or whether or not the information is to be obtained, thereby enabling to reduce a processing burden.

According to the embodiments described, it is decided whether or not own vehicle has approached at least one of a point difficult of a driving operation, an intersection, and a junction, and when it is decided that own vehicle has approached, information on positions and the like of other vehicles are obtained. Thus, information on positions and the like of the other vehicles is obtained, in a situation where a driver of own vehicle wishes to recognize dynamic information on the other vehicles.

Further, relative positions and the like are calculated based on the obtained positional information and the like of the other vehicles and positional information and the like of own vehicle, and other vehicles which are to be opponents of radio communications with own vehicle are searched for and decided based on the calculated information. Here, other vehicles required to be opponents of communications with own vehicle are not all vehicles around own vehicle, but those vehicles which affect running of own vehicle. Thus, in the present invention, there are searched for and decided other vehicles which affect running of own vehicle by calculating relative positions and the like of the other vehicles, except for other vehicles which do not affect running of own vehicle.

Moreover, the communication opponents of own vehicle are changed over to the other vehicles searched for and decided in the above manner, so that own vehicle is communicatively connected with the other vehicles around own vehicle which affect running of own vehicle. Then, information is obtained via radio communications from the communicatively connected other vehicles while conducting information obtainment in a time-sequential manner, thereby enabling obtainment of dynamic information on the communicatively connected other vehicles which affect running of own vehicle.

This enables to obtain dynamic information on the other vehicles affecting running of own vehicle.

The contents of Japanese Patent Application No. 2004-004261, filed to the Japanese Patent Office on Jan. 9, 2004, are incorporated herein by reference.

Although the present invention has been described based on the embodiments, the present invention is not limited thereto, and various modifications may be made thereto without departing from the spirit or scope of the present invention.

What is claimed is:

1. A vehicular communications apparatus mounted on an own vehicle for radio communications with other vehicles, comprising:

a memory configured to store information on at least one of a point difficult of a driving operation, an intersection, and a junction;

an own vehicle information detector configured to detect information on a position, a velocity, and a moving direction of the own vehicle;

an approach decider configured to decide whether the own vehicle has approached the point, intersection, or junction stored in the memory, based on information detected by the own vehicle information detector;

an other vehicle information request provider configured to provide requests to other vehicles for information on positions, velocities, and moving directions of the other vehicles, as the own vehicle is decided to have approached the point, intersection, or junction stored in the memory by the approach decider;

a calculator configured to calculate relative positions, relative velocities, and relative moving directions between the own vehicle and the other vehicles, respectively, based on information detected by the own vehicle information detector and information returned from the other vehicles in response to the requests from the other vehicle information request provider;

a communication opponent searching decider configured to search for, and to decide, other vehicles to be opponents of radio communications, based on information calculated by the calculator;

a communication opponent changer configured to change over communication opponents to the other vehicles searched for and decided by the communication opponent searching decider; and a radio communicator configured for radio communications with the communication opponents changed over by the communication opponent changer.

2. The vehicular communications apparatus as claimed in claim 1, wherein the communication opponent searching decider includes:

a searcher configured to search for the other vehicles to be opponents of radio communications with the own vehicle, based on information calculated by the calculator; and a decider configured to decide communication opponents from among the searched other vehicles; and wherein the searcher is configured to list the other vehicles which are present within a range narrower than a maximum communicable range, in accordance with a predetermined protocol, and wherein the decider is configured to decide the communication opponents from among the other vehicles listed by the searcher.

3. The vehicular communications apparatus as claimed in claim 2, wherein the searcher is configured to list the other vehicles in a closer order thereof to the own vehicle, based on information on relative positions calculated by the calculator.

4. The vehicular communications apparatus as claimed in claim 2, wherein the searcher is configured to list the other vehicles in an approaching order thereof to the own vehicle, based on information on relative velocities and relative moving directions calculated by the calculator.

5. The vehicular communications apparatus as claimed in claim 4, further comprising a restrictor configured to restrict information which is received by the radio communicator and is to be obtained by the own vehicle.

6. The vehicular communications apparatus as claimed in claim 5, wherein the communication opponent changer is configured to change over types of information to be requested to the other vehicles for obtainment, based on the relative positions calculated by the calculator.

7. The vehicular communications apparatus as claimed in claim 5, wherein the memory is configured to store map information therein, and wherein the communication opponent changer is configured to change over types of information to be requested to the other vehicles for obtainment, based on information on the position of the own vehicle obtained by the own vehicle information obtainer and the map information stored in the memory.

8. The vehicular communications apparatus as claimed in claim 5, wherein the communication opponent changer is configured to change over types of information to be requested to the other vehicles for obtainment, based on at least one of the relative velocities calculated by the calculator and the information on the position of the own vehicle obtained by the own vehicle information obtainer.

9. The vehicular communications apparatus as claimed in claim 8, wherein the communication opponent changer is configured to judge information to be radio communicated between the own vehicle and the other vehicles, by flags.

10. A vehicular communications apparatus mounted on an own vehicle for radio communications with other vehicles; wherein the vehicular communications apparatus is configured to calculate information on relative positions, relative velocities, and relative moving directions between the own vehicle and other vehicles as the own vehicle has approached at least one of a point difficult of a driving operation, an intersection, and a junction; and wherein the vehicular communications apparatus is configured to: search for and decide other vehicles which are to be opponents of communicative connection, based on a calculated result; obtain information from the decided other vehicles, in a time-sequential manner and by radio communications; and present the obtained information to a driver of the own vehicle from time to time.

11. A vehicular communications apparatus mounted on an own vehicle for radio communications with other vehicles, comprising:

memory means for storing information on at least one of a point difficult of a driving operation, an intersection, and a junction;

own vehicle information detecting means for detecting information on a position, a velocity, and a moving direction of the own vehicle;

approach deciding means for deciding whether the own vehicle has approached the point, intersection, or junction stored in the memory means, based on information detected by the own vehicle information detecting means;

other vehicle information request providing means for providing requests to other vehicles for information on positions, velocities, and moving directions of the other vehicles, as the own vehicle is decided to have approached the point, intersection, or junction stored in the memory means by the approach deciding means;

calculating means for calculating relative positions, relative velocities, and relative moving directions between the own vehicle and the other vehicles, respectively, based on information detected by the own vehicle information detecting means and information returned from the other vehicles in response to the requests from the other vehicle information request providing means;

communication opponent searching deciding means for searching for, and deciding, other vehicles to be opponents of radio communications, based on information calculated by the calculating means;

communication opponent changing means for changing over communication opponents to the other vehicles searched for and decided by the communication opponent searching deciding means; and radio communication means for performing radio communications with the communication opponents changed over by the communication opponent changing means.

12. A vehicular communications method for radio communications between an own vehicle and other vehicles, comprising:

storing information on at least one of a point difficult of a driving operation, an intersection, and a junction;

detecting information on a position, a velocity, and a moving direction of the own vehicle;

deciding whether the own vehicle has approached the stored point, intersection, or junction, based on detected information of the own vehicle;

providing requests to other vehicles for information on positions, velocities, and moving directions of the other vehicles, as the own vehicle is decided to have approached the stored point, intersection, or junction;

calculating relative positions, relative velocities, and relative moving directions between the own vehicle and the other vehicles, respectively, based on detected information of the own vehicle and information returned from the other vehicles in response to the requests;

searching for, and deciding, other vehicles to be opponents of radio communications, based on calculated information;

changing over communication opponents to the other vehicles thus searched for and decided; and performing radio communications with the changed communication opponents.

* * * * *